US011701299B1

(12) United States Patent
Heberle et al.

(10) Patent No.: US 11,701,299 B1
(45) Date of Patent: Jul. 18, 2023

(54) RECEPTACLE TO ILLUMINATE AN OUTER SURFACE OF A CONTAINER

(71) Applicants: Phillip Heberle, Canandaigua, NY (US); James Heberle, Shortsville, NY (US)

(72) Inventors: Phillip Heberle, Canandaigua, NY (US); James Heberle, Shortsville, NY (US)

(73) Assignee: Phillip Heberle, Canandaigua, NY (US)

( * ) Notice: Subject to any disclaimer, the term of this patent is extended or adjusted under 35 U.S.C. 154(b) by 0 days.

(21) Appl. No.: 18/076,347

(22) Filed: Dec. 6, 2022

(51) Int. Cl.
*A61J 1/16* (2023.01)
*A61J 1/14* (2023.01)
*A47G 19/22* (2006.01)

(52) U.S. Cl.
CPC ..... *A61J 1/16* (2013.01); *A47G 19/2227* (2013.01); *A61J 1/1468* (2015.05); *A47G 2019/2238* (2013.01)

(58) Field of Classification Search
CPC ..... A47G 19/2227; A47G 2019/2238; A61J 1/1468; A61J 1/16
See application file for complete search history.

(56) References Cited

U.S. PATENT DOCUMENTS 5,575,553 A * 11/1996 Tipton ..... A47G 19/2227 362/101
7,081,807 B2 7/2006 Lai
2014/0240962 A1* 8/2014 Wang ..... A47G 19/2227 362/101
2020/0069090 A1* 3/2020 Bloom ..... A47G 19/2227

* cited by examiner

*Primary Examiner* — Thomas M Sember

(74) *Attorney, Agent, or Firm* — Tracy Jong Law Firm; Tracy P. Jong; Cheng Ning Jong

(57) ABSTRACT

A receptacle for receiving a bottom portion of a container having an outer surface and a bottom surface, the receptacle including a structure including a wall comprising at least one light transmission property, a top surface and a side surface; and a light emitting device configured to be disposed such that a light emission of the light emitting device is transmissible through the top surface of the structure onto the outer surface of the container and through the bottom surface of the container to illuminate the outer surface of the container.

20 Claims, 3 Drawing Sheets

RECEPTACLE TO ILLUMINATE AN OUTER SURFACE OF A CONTAINER

BACKGROUND OF THE INVENTION

1. The Field of the Invention

The present invention relates to a receptacle for illuminating a container. More specifically, the present invention is directed to a receptacle for illuminating a medicine or pill container.

2. Background Art

Traditional medicine containers or bottles are generally used to safely store pills or medicines for patients to access in time of need. Many, especially aging patients with diminished, low or compromised vision, are prescribed medicines for various ailments that come in multiple pill containers. Some pills are taken at regular intervals, e.g., daily, after a meal or when the patient experiences one or more symptoms of a condition. With more than one pill bottle, the ability to retrieve the right pill or pills is critical to avoid the consumption of the wrong pills which can have grave effects on the patient due to an overdose of a particular medicine while not having the right pill or pills to address the condition at hand. Therefore, it is critical for a patient to retrieve one or more pills from the right container. This, however can be a challenge, especially if the patient has diminished, low or compromised vision while the patient is required to take more than one medicine and the pills come in similarly or identically-shaped and sized containers where the only distinguishing feature of one bottle from another is the label disposed on the bottle often having small prints indicating the contents of the bottle. When a medication is required under low light conditions and when the patient is not fully awake, e.g., when the patient wakes up from sleep, the patient must still ascertain the appropriate medication is being taken. It is under these conditions when the patient will most likely confuse one medication bottle for another.

Various attempts have been made in the past to try to increase and improve compliance by patients to take their medication, one of which is a reminder system which incorporates a timer with a pill bottle. U.S. Pat. No. 7,081,807 to Lai discloses an electronic pill reminder device that that is retrofitted inside a regular conventional pill bottle cap installed inside the conventional pill bottle between the bottle cap and the bottle container. When a user closes the pill bottle cap on the bottle container, an electronic timer, with a factory predetermined time interval, is activated. The timer generates alert signals to remind a user that a last pill has been taken and to remind the user to take his next dose. Although Lai's device includes among other components, an LED configured for generating a light signal to alert a patient, the LED is not configured to be disposed in a manner suitable to aid the patient in reading the prints on the label of the bottle.

There exists a need for a device suitable to be used in conjunction with a pill bottle for illuminating the label of a pill bottle such that the contents of the pill bottle can be ascertained under low light conditions.

SUMMARY OF THE INVENTION

In accordance with the present invention, there is provided a receptacle for receiving a bottom portion of a container having an outer surface and a bottom surface, the receptacle including:

a structure including:

(a) a wall including at least one light transmission property, and a top surface; and (b) a light emitting device configured to be disposed such that a light emission of the light emitting device is transmissible through the top surface of the structure onto the outer surface of the container and through the bottom surface of the container to illuminate the outer surface of the container.

The at least one light transmission property can be transparency or translucency.

In accordance with the present invention, there is further provided a receptacle for receiving a bottom portion of a container having an outer surface and a bottom surface, the receptacle including:

a structure including:

(a) a wall including a top surface; and (b) a light emitting device configured to be disposed in the wall such that a light emission of the light emitting device is emitted from the top surface of the structure onto the outer surface of the container.

In accordance with the present invention, there is further provided a receptacle for receiving a cap of a container having an outer surface, the receptacle including:

a structure including:

(a) a wall including a bottom surface; and (b) a light emitting device configured to be disposed in the wall such that a light emission of the light emitting device is emitted from the bottom surface of the structure onto the outer surface of the container.

The container can be cylindrical or rectangular and the bottom portion of the container can be circular or rectangular. In one embodiment, the receptacle further includes a controller and a switch, the switch is functionally connected to the controller, the light emitting device is functionally connected to the controller, wherein an activation of the switch is configured to turn on the light emitting device for a period. In one embodiment, the period is about 30-90 seconds. In one embodiment, the receptacle further includes a switch configured to selectively power the light emitting device wherein an activation of the switch is configured to turn on the light emitting device. In one embodiment, the switch is a device selected from the group consisting of an on-off switch, a tilt switch, a motion sensor, an ultrasonic sensor and an infrared sensor. In one embodiment, the light emitting device includes at least one light source including at least one light emitting diode (LED). In one embodiment, the receptacle further includes a controller and a communication module, the light emitting device is functionally connected to the controller, the communication module is functionally connected to the controller, wherein the communication module is configured to enable one of an activation command and a deactivation command of the light emitting device through the controller.

An object of the present invention is to provide a receptacle to illuminate an outer surface of a medicine container so that a patient can easily read the label disposed on the medicine container under a low light condition.

Another object of the present invention is to provide a receptacle to illuminate an outer surface of a medicine container where the receptacle can be adapted to the medicine container without modifying the medicine container.

Another object of the present invention is to provide a receptacle to illuminate an outer surface of a medicine container where the receptacle can be adapted to the medicine container without modifying the medicine container and without undue effort.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—receptacle
4—medicine container, e.g., pill bottle
6—container
8—cap
10—label
12—light emitting device
14—wall
16—top surface of wall
18—bottom wall of container
20—pill
22—light rays transmitted through top surface of wall
24—light rays transmitted through bottom wall of container
26—switch
28—cavity of receptacle
30—emitted light
32—battery
34—controller
36—communication module
38—audio device
40—bottom surface

PARTICULAR ADVANTAGES OF THE INVENTION

In one embodiment, a present receptacle can be adapted to a bottom portion of a medicine container to illuminate a label disposed thereon. In another embodiment, a present receptacle can be adapted to a cap of a medicine container to illuminate a label disposed on the medicine container, thereby providing a user an option as to the type of adaptation of the receptacle desired. Some users may prefer a present receptacle that is adaptable to a bottom portion of a medicine container as it does not interfere with the cap of the medicine container which serves as a grasping point of the cap in an effort to open or close the medicine container. Some users may prefer a present receptacle that is adaptable to the cap of a medicine container as it provides a larger surface area for the users to grasp the cap in an effort to open or close the medicine container.

In one embodiment, light rays emitted from a light emitting device of the present receptacle are transmitted via a wall of the receptacle and potentially additionally through a bottom wall of the receptacle, reducing the wall size of the receptacle for accommodating one or more light emitting devices.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
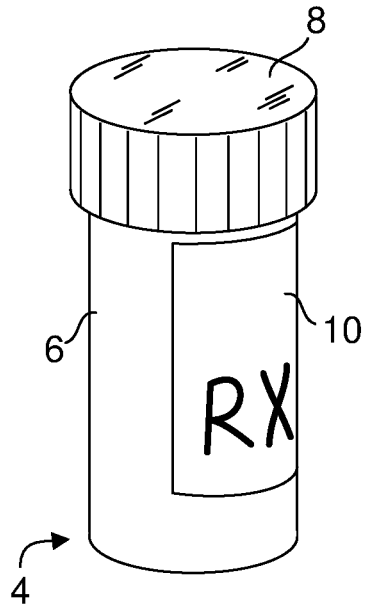
FIG. 1 is a top perspective view of a medicine container.

FIG. 1 illustrates a top perspective view of a medicine container 4, e.g., a pill bottle containing pills. As shown, the medicine container 4 includes a cylindrically-shaped container 6 having a cross-sectional profile of a bottom portion that is circular. In an embodiment not shown, a medicine container 4 may alternatively include a rectangularly-shaped container having cross-sectional profile of a bottom portion that is rectangular. The inventive concept of a present receptacle does not lie in the shape of a medicine container the present receptacle can be adapted to, but rather its ability to be coupled to the medicine container without requiring any modifications to the medicine container and the ease with which the receptacle can be adapted to a medicine container. A cap 8 is typically provided to safely contain the pills therein and a label 10 is affixed to an exterior surface of the container 4 by adhesive. A pharmacist typically uses a generic pill bottle 4 and sticks on a machine-printed label 10, specific to the patient for which the medicine is prescribed with instructions on the dose and frequency of the medicine. To open a cylindrical container 6 to retrieve the medicine, the patient will need to grasp the cap 10, push down sufficiently to turn the cap 10 counter-clockwise with respect to the container. This compresses the elastomer gasket between the inner surface of the cap 10 and the top surface of the container 6, as well as unlocking a set of interlocking tangs on the cap 10 and container 6. The cap 10 frequently has splines on its exterior circumference to increase the friction between the cap 10 and the patient's fingers when the patient is grasping and turning the cap 10. When the container 6 is rectangular, the cap 10 will be rectangular and have a snap fit over the open end of the container 6.

Figure 2:
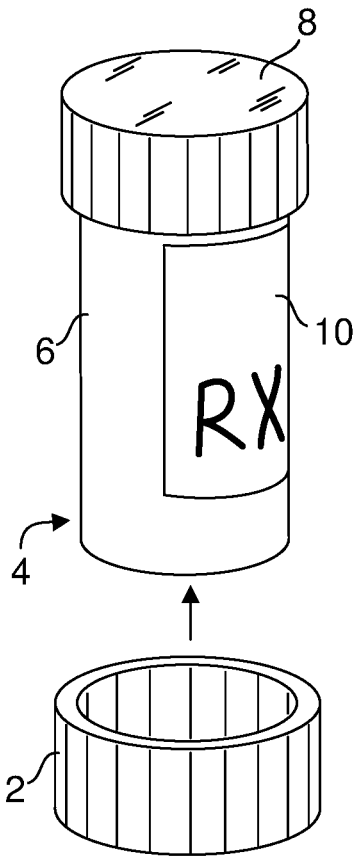
FIG. 2 is a top perspective view of a medicine container and a receptacle aligned to be adapted to the medicine container.
Figure 3:
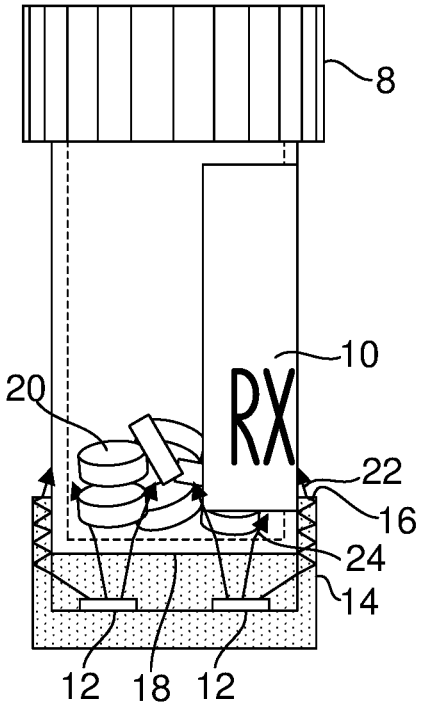
FIG. 3 is a side partially transparent view of a medicine container with a receptacle having been adapted to a bottom portion of the medicine container.

FIG. 2 is a top perspective view of a medicine container 6 and a receptacle 2 aligned to be adapted to the medicine container. FIG. 3 is a side partially transparent view of a medicine container 6 with a receptacle 2 having been adapted to a bottom portion of the medicine container 6. The receptacle includes a structure including a wall 14 and a light emitting device 12. The wall 14 includes at least one light transmission property and a top surface 16. The light emitting device 12 is configured to be disposed such that a light emission of the light emitting device 12 is transmissible through the top surface 16 of the structure onto the outer surface of the container 6 and through the bottom surface 18 of the container 6 to illuminate the outer surface of the container. In one embodiment, the at least one light transmission property can be transparency. In another embodiment, the at least one light transmission property can be translucency.

To assemble the container 6 and receptacle 2, the bottom portion of the container 6 is inserted into the cavity 28 of the receptacle 2 until a bottom wall 18 of the container 6 meets a top surface of the bottom of the receptacle 2. The receptacle 2 is preferably constructed from a material with a surface capable of providing sufficient friction, restriction or interference between the container 6 and receptacle 2 to hold the receptacle in place. The material selected for the receptacle 2 should be chosen to optimize this friction by selecting a material having a coefficient of friction between the receptacle 2 material and the container material 6 that provides sufficient friction while not too large that it becomes difficult to install the receptacle. In other words, the friction should not preclude the insertion of the container 6 into the receptacle 2 or removal of the container 6 from the receptacle 2 when the receptacle 2 is to be separated from the container 6 to be reused on a new container. In other words, the friction should not preclude insertion of the container 6 into the receptacle 2 or removal of the container 6 from the receptacle 2 when the medication has been exhausted and that the receptacle is desired to be removed from the receptacle. It shall be seen then that the receptacle 2 can be adapted to the medicine container without modifying the medicine container and without undue effort. In order to avoid detachment of an installed receptacle, in use, the medicine container is preferably picked up by its container or cap. When the medicine container is desired to be opened, the medicine container is preferably grasped by its container only and not also the receptacle such that the cap can be twisted and pushed against the container to remove the cap from the container without affecting the installed receptacle.

Referring again to FIG. 3, even when pills 20 are still disposed within the container 6, some light rays can penetrate the bottom wall 18 of the container 6 and the pills 20 to aid in illuminating the label 10 from inside of the container 6. Therefore, the light emitting devices 12 emit light rays 22 transmitted through the top surface 16 of the container wall onto the label 10 on the outer surface of the container 6 as well as light rays 24 transmitted through the bottom wall 18 of the container 6 to illuminate the label 10 on the outer surface of the container 6. The light emitting device includes at least one light source, e.g., a light emitting diode (LED). In one embodiment, the material of the receptacle 2 is transparent. In another embodiment, the material of the receptacle 2 is translucent. In one embodiment, the receptacle 2 includes a controller and a switch 26 functionally connected to a controller as disclosed elsewhere herein. The light emitting device 12 is also functionally connected to the controller as disclosed elsewhere herein. An activation of the switch is configured to turn on the light emitting device for a period. In one embodiment, the period is about 30 to 90 seconds. The switch 26 can be an on-off switch, a tilt switch, a motion sensor, an ultrasonic sensor or an infrared sensor. In one embodiment, the receptacle 2 of FIG. 3 further includes a communication module functionally connected to the controller as disclosed elsewhere herein. The communication module is configured to enable one of an activation command and a deactivation command of the light emitting device through the controller.

Figure 4:
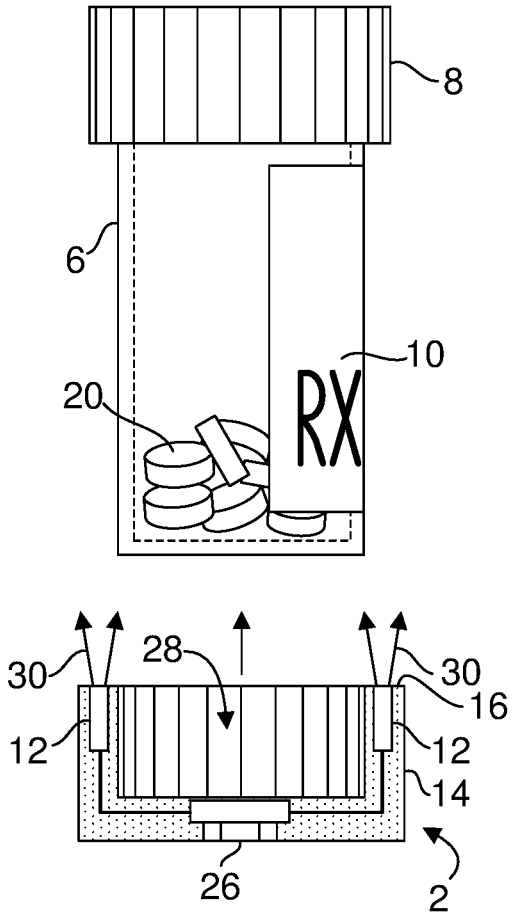
FIG. 4 is a side partially transparent view of a medicine container with a receptacle aligned to be adapted to a bottom portion of the medicine container.
Figure 5:
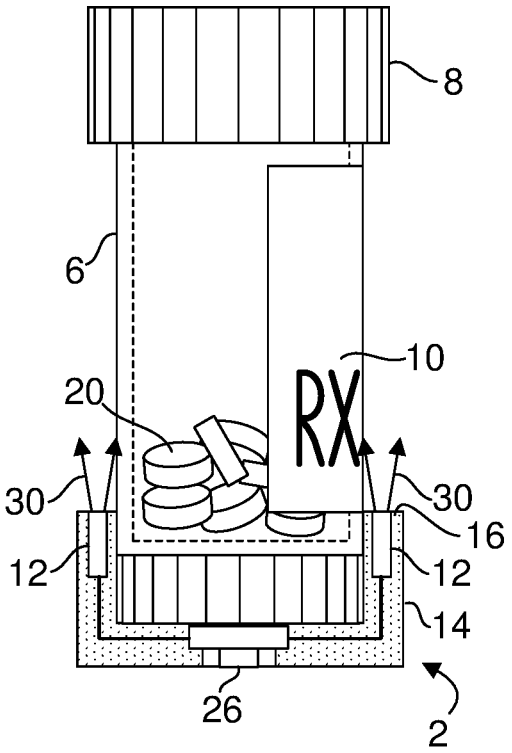
FIG. 5 is a side partially transparent view of a medicine container with a receptacle having been adapted to a bottom portion of the medicine container.

FIG. 4 is a side partially transparent view of a medicine container 6 with a receptacle 2 aligned to be adapted to a bottom portion of the medicine container 6. FIG. 5 is a side partially transparent view of a medicine container 6 with a receptacle 2 having been adapted to a bottom portion of the medicine container 6. The receptacle 2 includes a structure including a wall 14 and at least one light emitting device 12. The wall 14 includes a top surface. The at least one light emitting device 12 is configured to be disposed in the wall 14 such that a light emission from the at least one light emitting device 12 is emitted from the top surface 16 of the wall 14 onto the outer surface of the container 6. There is preferably a plurality of light emitting devices 12 embedded in the wall 14 and distributed along the top surface 16 of the wall 14 to ensure that some light is available to be cast onto the label 10 at any orientation of the receptacle 2 with respect to the container 6, making the receptacle 2 orientationally-agnostic with respect to the container 6 and therefore making it easier to install the receptacle 2 on a container 6.

The embodiment of the receptacle 2 shown in FIGS. 4 and 5 is essentially the same as the embodiment shown in FIGS. 2 and 3 except that the light emitting device 12 in FIGS. 4 and 5 is disposed in the wall 14 to illuminate the outer surface of the container 6 and the label 10 and no light is configured to be transmitted through the bottom wall 18 of the container 6 and the light emitting devices 12 are themselves disposed closer to the outer surface of the container 6 and the label 10. Also, for the embodiment of the receptacle 2 shown in FIGS. 4 and 5, transparency or translucency of the material of receptacle 2 is not a requirement as no light is configured to be transmitted through the wall 14 of the receptacle 2 or bottom wall 18 of the container 6.

Figure 6:
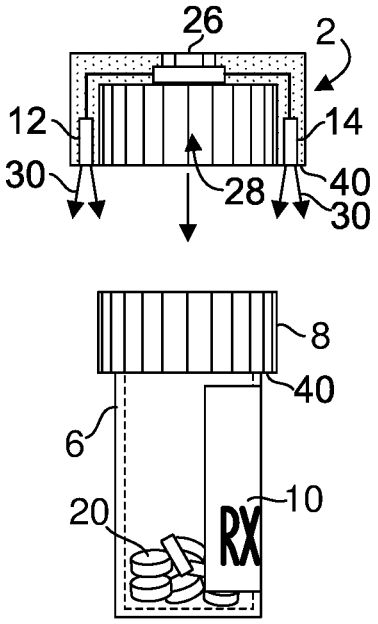
FIG. 6 is a side partially transparent view of a medicine container with a receptacle aligned to be adapted to the cap of the medicine container.
Figure 7:
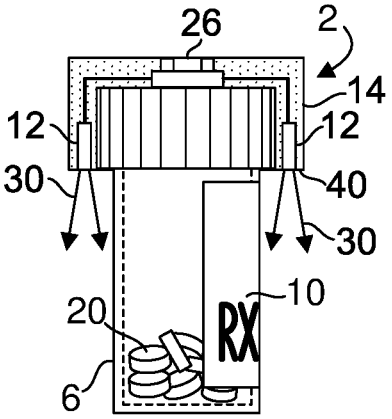
FIG. 7 is a side partially transparent view of a medicine container with a receptacle having been adapted to the cap of the medicine container.
Figure 8:
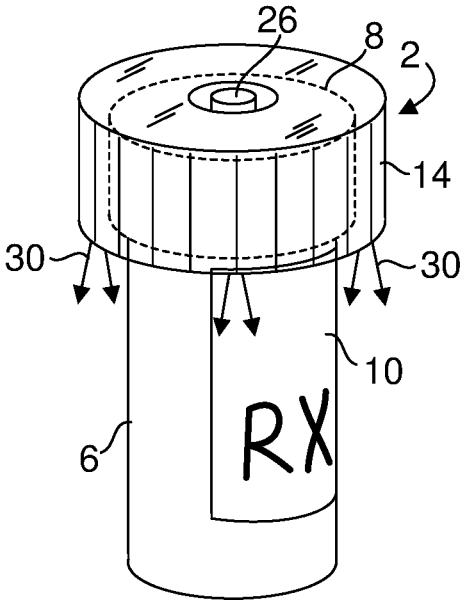
FIG. 8 is a top perspective partially transparent view of a medicine container with a receptacle having been adapted to the cap of the medicine container.

FIG. 6 is a side partially transparent view of a medicine container 6 with a receptacle 2 aligned to be adapted to the cap of the medicine container 6. FIG. 7 is a side partially transparent view of a medicine container with a receptacle 2 having been adapted to the cap 8 of the medicine container 6. FIG. 8 is a top perspective partially transparent view of a medicine container 6 with a receptacle 2 having been adapted to the cap 8 of the medicine container 6. The receptacle 2 includes a structure including a wall 14 and a light emitting device 12. The wall 14 includes a bottom surface 40. The light emitting device 12 is configured to be disposed in the wall 14 such that a light emission from the light emitting device 12 is emitted from the bottom surface of the wall onto the outer surface of the container. The embodiment of the receptacle 2 shown in FIGS. 6-8 is essentially the same as the embodiment shown in FIGS. 4 and 5 except the receptacle 2 is sized suitably to be placed over the cap 8 of a medicine container. When the receptacle 2 is adapted to the cap 8, the cavity 28 of the receptacle 2 should be fully pushed down over the cap 8 until the inner wall of the receptacle 2 meets a top surface of the cap 8. An appropriate material shall be selected for the receptacle 2 to maximize the friction between the receptacle 2 and the cap 8 when the user pushes down and twists the receptacle 2 to remove the receptacle 2 and cap 8 as a pair from the container 6 when retrieving a pill. Splines on the cap 8 enhance this friction. Alternatively, if the patient would prefer to remove the receptacle 2 from the cap 8 before retrieving a pill from the container 6, then the fit of the receptacle 2 to the cap 8 should be sufficiently loose to permit that.

Figure 9:
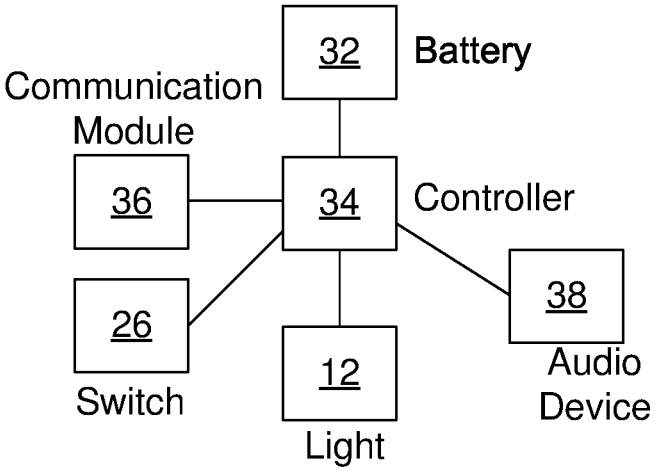
FIG. 9 is a diagram depicting one embodiment of the system of present receptacle

FIG. 9 is a diagram depicting one embodiment of the system of present receptacle 2. FIG. 9 illustrates a graphical system schematic of a controller 34 functionally connected to a communication module 36, switch 26, light emitting device 12. The controller 34 and any devices functionally connected to it may be powered by a battery 32. In the embodiment shown, an audio device 38 is further functionally connected to the controller 34. For instance, the audio device 38 can be configured to enable delivery of a prerecorded message to the patient where such delivery can be associated with the status of the switch 26. In one embodiment, the communication module is configured to communicate wirelessly with a mobile device, e.g., a mobile phone, where the light emitting devices 12 can be controlled, e.g., turned on or off wirelessly from the mobile device.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A receptacle for receiving a bottom portion of a container having an outer surface, a width and a bottom wall, the receptacle comprising:

a structure comprising:

(a) a wall surrounding a space configured for receiving the bottom portion of the container, wherein said wall comprising a width greater than the width of the container, having at least one light transmission property, and a top surface; and (b) a light emitting device configured to be disposed such that a light emission of said light emitting device is transmissible at least partially through said top surface of said wall onto the outer surface of the container and at least partially through the bottom wall of the container to illuminate the outer surface of the container.

2. The receptacle of claim 1, wherein said at least one light transmission property comprises a property selected from the group consisting of transparency and translucency.

3. The receptacle of claim 1, wherein the container comprises a shape selected from the group consisting of a cylindrical shape and a rectangular shape and the bottom portion of the container comprises a shape selected from the group selected from a circular shape and a rectangular shape.

4. The receptacle of claim 1, further comprising a controller and a switch, said switch functionally connected to said controller, said light emitting device is functionally connected to said controller, wherein an activation of said switch is configured to turn on said light emitting device for a period.

5. The receptacle of claim 4, wherein said period is about 30-90 seconds.

6. The receptacle of claim 1, further comprising a switch configured to selectively power said light emitting device wherein an activation of said switch is configured to turn on said light emitting device.

7. The receptacle of claim 6, wherein said switch is a device selected from the group consisting of an on-off switch, a tilt switch, a motion sensor, an ultrasonic sensor and an infrared sensor.

8. The receptacle of claim 1, wherein said light emitting device comprises at least one light source comprising at least one light emitting diode (LED).

9. The receptacle of claim 1, further comprising a controller and a communication module, said light emitting device is functionally connected to said controller, said communication module is functionally connected to said controller, wherein said communication module is configured to enable one of an activation command and a deactivation command of said light emitting device through said controller.

10. A receptacle for receiving a bottom portion of a container having an outer surface, a width and a bottom surface, the receptacle comprising:

a structure having a width greater than the width of the container, said structure comprising:

(a) a wall comprising a top surface; and (b) a light emitting device configured to be disposed in said wall such that a light emission of said light emitting device is emitted from said top surface of said structure onto the outer surface of the container.

11. The receptacle of claim 10, wherein the container comprises a shape selected from the group consisting of a cylindrical shape and a rectangular shape and the bottom portion of the container comprises a shape selected from the group selected from a circular shape and a rectangular shape.

12. The receptacle of claim 10, further comprising a controller and a switch, said switch functionally connected to said controller, said light emitting device is functionally connected to said controller, wherein an activation of said switch is configured to turn on said light emitting device for a period.

13. The receptacle of claim 10, further comprising a switch configured to selectively power said light emitting device wherein an activation of said switch is configured to turn on said light emitting device.

14. The receptacle of claim 13, wherein said switch is a device selected from the group consisting of an on-off switch, a tilt switch, a motion sensor, an ultrasonic sensor and an infrared sensor.

15. The receptacle of claim 10, further comprising a controller and a communication module, said light emitting device is functionally connected to said controller, said communication module is functionally connected to said controller, wherein said communication module is configured to enable one of an activation command and a deactivation command of said light emitting device through said controller.

16. A receptacle for receiving a cap of a container having a width and an outer surface, the receptacle comprising:

a structure having a width greater than the width of the container, said structure comprising:

(a) a wall comprising a bottom surface; and (b) a light emitting device configured to be disposed in said wall such that a light emission of said light emitting device is emitted from said bottom surface of said structure onto the outer surface of the container.

17. The receptacle of claim 16, wherein the container comprises a shape selected from the group consisting of a cylindrical shape and a rectangular shape and the bottom portion of the container comprises a shape selected from the group selected from a circular shape and a rectangular shape.

18. The receptacle of claim 16, further comprising a controller and a switch, said switch functionally connected to said controller, said light emitting device is functionally connected to said controller, wherein an activation of said switch is configured to turn on said light emitting device for a period.

19. The receptacle of claim 16, further comprising a switch configured to selectively power said light emitting device wherein an activation of said switch is configured to turn on said light emitting device.

20. The receptacle of claim 16, further comprising a controller and a communication module, said light emitting device is functionally connected to said controller, said communication module is functionally connected to said controller, wherein said communication module is configured to enable one of an activation command and a deactivation command of said light emitting device through said controller.

* * * * *